US009118123B2

(12) United States Patent
Kawamura et al.

(10) Patent No.: US 9,118,123 B2
(45) Date of Patent: Aug. 25, 2015

(54) CRIMP TERMINAL, CRIMP-CONNECTION STRUCTURAL BODY, AND METHOD FOR MANUFACTURING CRIMP-CONNECTION STRUCTURAL BODY

(71) Applicants: FURUKAWA ELECTRIC CO., LTD., Tokyo (JP); FURUKAWA AUTOMOTIVE SYSTEMS INC., Inukami-gun (JP)

(72) Inventors: Yukihiro Kawamura, Shiga (JP); Takashi Tonoike, Shiga (JP); Takuro Yamada, Shiga (JP)

(73) Assignees: FURUKAWA ELECTRIC CO., LTD., Tokyo (JP); FURUKAWA AUTOMOTIVE SYSTEMS INC., Inukami-gun (JP)

( * ) Notice: Subject to any disclaimer, the term of this patent is extended or adjusted under 35 U.S.C. 154(b) by 0 days.

(21) Appl. No.: 14/481,293

(22) Filed: Sep. 9, 2014

(65) Prior Publication Data

US 2014/0377991 A1 Dec. 25, 2014

Related U.S. Application Data

(63) Continuation of application No. PCT/JP2013/084411, filed on Dec. 24, 2013.

(30) Foreign Application Priority Data

Feb. 22, 2013 (JP) ..... 2013-033874

(51) Int. Cl.
*H01R 4/10* (2006.01)
*H01R 4/18* (2006.01)
(Continued)

(52) U.S. Cl.
CPC ..... *H01R 4/183* (2013.01); *H01R 4/187* (2013.01); *H01R 4/206* (2013.01); *H01R 4/62* (2013.01); *H01R 43/048* (2013.01); *Y10T 29/49185* (2015.01)

(58) Field of Classification Search
CPC ..... H01R 4/185; H01R 4/20; H01R 4/188; H01R 43/058; H01R 43/16; H01R 43/24; H01R 13/5845; H01R 13/5205; H01R 13/5216; H01R 13/504
USPC ..... 439/877, 822, 948
See application file for complete search history.

(56) References Cited

U.S. PATENT DOCUMENTS 2,493,311 A * 1/1950 Odell ..... 338/28
(Continued)

FOREIGN PATENT DOCUMENTS

EP 2 200 121 A1 6/2010
(Continued)

OTHER PUBLICATIONS

Extended Search Report issued Dec. 4, 2014 in European patent Application No. 13875327.2.
(Continued)

*Primary Examiner* — Abdullah Riyami
*Assistant Examiner* — Vladimir Imas
(74) *Attorney, Agent, or Firm* — Oblon, McClelland, Maier & Neustadt, L.L.P.

(57) ABSTRACT

A crimp terminal includes; a crimping portion and a cover covering the conductor portion, the crimping portion is formed in a hollow cylindrical shape in cross section and has a first end portion and a second end portion opposite to the first end portion. The conductor portion is inserted into the first end portion in a longitudinal direction, and the second end is sealed. The second end portion at the opposite side is sealed by welding. The crimping portion, in which the exposed conductor portion is crimped, further includes a locking section locking the exposed conductor portion. A length between the first end portion into which the conductor portion is inserted and a portion, of the locking section, that is the closest to the first end portion is larger than a length of the exposed conductor portion of the insulated wire.

9 Claims, 13 Drawing Sheets

(51) Int. Cl.

| | |
|---|---|
| ***H01R 4/20*** | (2006.01) |
| ***H01R 4/62*** | (2006.01) |
| ***H01R 43/048*** | (2006.01) |

(56) References Cited

U.S. PATENT DOCUMENTS

| | | | | |
|---|---|---|---|---|
| 2,685,076 | A * | 7/1954 | Hoffman | 439/882 |
| 2,724,098 | A * | 11/1955 | Bergan | 439/879 |
| 2,800,638 | A * | 7/1957 | Hammell | 439/882 |
| 2,981,787 | A * | 4/1961 | Brautigam et al. | 174/84 C |
| 3,955,044 | A * | 5/1976 | Hoffman et al. | 174/84 C |
| 4,074,065 | A * | 2/1978 | Leaf et al. | 174/87 |
| 5,519,170 | A * | 5/1996 | Nabeshima | 174/74 R |
| 5,667,413 | A * | 9/1997 | Trafton | 439/843 |
| 5,749,756 | A * | 5/1998 | Vockroth et al. | 439/879 |
| 6,056,605 | A * | 5/2000 | Nguyen et al. | 439/882 |
| 6,334,798 | B1 * | 1/2002 | Ushijima et al. | 439/879 |
| 6,517,381 | B2 * | 2/2003 | Kondo | 439/604 |
| 6,770,817 | B2 * | 8/2004 | Kuwayama et al. | 174/84 C |
| 6,971,905 | B2 * | 12/2005 | Makita et al. | 439/447 |
| 7,419,395 | B2 * | 9/2008 | Tsuji et al. | 439/271 |
| 7,494,388 | B2 * | 2/2009 | Kakuta | 439/879 |
| 7,597,596 | B2 * | 10/2009 | Watanabe | 439/877 |
| 7,663,059 | B2 * | 2/2010 | Daitou | 174/77 R |
| 7,775,842 | B2 * | 8/2010 | Yamagami | 439/877 |
| 7,905,755 | B1 * | 3/2011 | Martauz | 439/877 |
| 7,954,235 | B2 * | 6/2011 | Martauz et al. | 29/855 |
| 8,167,666 | B2 * | 5/2012 | Koga et al. | 439/852 |
| 8,210,884 | B2 * | 7/2012 | Corman et al. | 439/877 |
| 8,360,803 | B2 * | 1/2013 | Sakai | 439/523 |
| 8,607,449 | B2 * | 12/2013 | Kitagawa et al. | 29/863 |
| 8,622,775 | B2 * | 1/2014 | Takashima et al. | 439/886 |
| 8,622,776 | B2 * | 1/2014 | Morikawa et al. | 439/886 |
| 8,834,213 | B2 * | 9/2014 | Sato et al. | 439/866 |
| 8,876,564 | B2 * | 11/2014 | Sato | 439/879 |
| 8,900,020 | B2 * | 12/2014 | Aoki et al. | 439/851 |
| 8,974,258 | B2 * | 3/2015 | Mitose et al. | 439/877 |
| 2002/0050385 | A1 * | 5/2002 | Murakami et al. | 174/74 R |
| 2004/0168315 | A1 * | 9/2004 | Onuma | 29/854 |
| 2006/0154516 | A1 * | 7/2006 | Padula | 439/521 |
| 2007/0184715 | A1 | 8/2007 | Onuma | |
| 2008/0076284 | A1 | 3/2008 | Sasaki et al. | |
| 2010/0147585 | A1 | 6/2010 | Kobayashi et al. | |
| 2010/0200261 | A1 * | 8/2010 | Boutot | 174/19 |
| 2012/0329343 | A1 * | 12/2012 | Sato et al. | 439/866 |
| 2013/0095708 | A1 * | 4/2013 | Mitose et al. | 439/878 |
| 2013/0273787 | A1 * | 10/2013 | Mitose et al. | 439/878 |
| 2014/0335745 | A1 * | 11/2014 | Kawamura et al. | 439/878 |
| 2014/0378009 | A1 * | 12/2014 | Yamada et al. | 439/865 |
| 2015/0017833 | A1 * | 1/2015 | Sato et al. | 439/519 |
| 2015/0020384 | A1 * | 1/2015 | Yamamoto | 29/863 |

FOREIGN PATENT DOCUMENTS

| | | | |
|---|---|---|---|
| EP | 2 555 328 | A1 | 2/2013 |
| JP | 03-081983 | A | 4/1991 |
| JP | H3-37760 | U | 4/1991 |
| JP | 09-007649 | A | 1/1997 |
| JP | 10-328862 | A | 12/1998 |
| JP | 2002-124310 | A | 4/2002 |
| JP | 2004-071437 | A | 3/2004 |
| JP | 2009-176537 | | 8/2009 |
| JP | 2010-244895 | A | 10/2010 |
| JP | 2010-538436 | A | 12/2010 |
| JP | 2011-233328 | A | 11/2011 |
| WO | WO 2014/014104 | A1 | 1/2014 |

OTHER PUBLICATIONS

International Search Report Issued on Apr. 8, 2014 for PCT/JP2013/084411 Filed on Dec. 24, 2013 (English Translation).

International Written Opinion Issued on Apr. 8, 2014 for PCT/JP2013/084411 Filed on Dec. 24, 2013.

U.S. Appl. No. 14/483,884, filed Sep. 11, 2014, Yamada, et al.

* cited by examiner

CRIMP TERMINAL, CRIMP-CONNECTION STRUCTURAL BODY, AND METHOD FOR MANUFACTURING CRIMP-CONNECTION STRUCTURAL BODY

CROSS-REFERENCE TO RELATED APPLICATIONS

This application is a continuation of PCT International Application No. PCT/JP2013/084411 filed on Dec. 24, 2013 which claims the benefit of priority from Japanese Patent Application No. 2013-033874 filed on Feb. 22, 2013, the entire contents of which are incorporated herein by reference.

BACKGROUND OF THE INVENTION

1. Field of the Invention

The present invention relates to a crimp terminal to which an insulated wire is crimp-connected, a crimp-connection structural body in which an insulated wire is crimp-connected to a crimp terminal, and a method for manufacturing a crimp-connection structural body.

2. Description of the Related Art

Today, since automobiles are equipped with various electric and electronic parts, electric circuits thereof are becoming more and more complex along with multi-functionalization and higher performance of automobiles, thus, supplying power to each of the electric and electronic parts stably is indispensable. Electric circuits of the automobiles equipped with the various electric and electronic parts are formed by arranging wire harnesses bundling a plurality of insulated wires and by connecting the wire harnesses with one another by connectors. In the connector connecting the wire harnesses with one another, the insulated wires are configured to be connected with one another by providing a crimp terminal crimping the insulated wires with crimping portion and fit-connecting a male crimp terminal to a female crimp terminal.

In a case where the insulated wires are crimp-connected with the crimping portion of the crimp terminal, a gap is produced between a conductor, made of an aluminum core wire or the like, exposed from an end portion of the insulating cover of the insulated wire and the crimping portion, and thus the exposed conductor is exposed to an open air. A moisture, which if permeates the crimping portion in this state, causes a surface of the exposed conductor to be corroded, thereby increasing an electric resistance, and thus decreasing the conductivity of the conductor. If the conductivity of the conductor decreases to a great degree, it is not possible to supply an electric power to the electric and electronic parts stably. Against such background for a conventional crimp terminal, a technology is proposed to restrain the conductivity of the conductor from decreasing because of the permeation of moisture. To be more specific, Japanese Laid-open Patent Publication No. 2011-233328 (hereinafter to be referred to as Patent Literature 1) discloses a technology of restraining the moisture from contacting the exposed conductor by covering the exposed conductor with a highly viscous resin-made insulator.

SUMMARY OF THE INVENTION

It is an object of the present invention to at least partially solve the problems in the conventional technology.

A crimp terminal according to one aspect of the present invention includes a crimping portion crimp-connecting a conductor portion exposed from an insulated wire including the conductor portion and a cover covering the conductor portion. The crimping portion is formed in a hollow cylindrical shape in cross section and has first end portion and a second end portion opposite to the first end portion. The conductor portion is inserted into the first end portion in a longitudinal direction, and the second end portion is sealed. The second end portion at the opposite side is sealed by welding. The crimping portion, in which the exposed conductor portion is crimped, further includes a locking section locking the exposed conductor portion. A length between the first end portion into which the conductor portion is inserted and a portion, of the locking section, that is the closest to the first end portion is larger than a length of the exposed conductor portion of the insulated wire.

A crimp-connection structural body according to another aspect of the present invention includes a crimp terminal which includes a crimping portion crimp-connecting a conductor portion exposed from an insulated wire including the conductor portion and a cover covering the conductor portion, and the insulated wire in which the conductor portion is crimp-connected to the crimp terminal. The crimping portion is formed in a hollow cylindrical shape in cross section and has a first end portion and a second end portion opposite to the first end portion. The conductor portion is inserted into the first end portion in a longitudinal direction, and the second end portion is sealed. The second end portion at the opposite side is sealed by welding. The crimping portion, in which the exposed conductor portion is crimped, further includes a locking section locking the exposed conductor portion. A length between the first end portion into which the conductor portion is inserted and a portion, of the locking section, that is the closest to the first end portion is larger than a length of the exposed conductor portion of the insulated wire.

A method for manufacturing a crimp-connection structural body according to still another aspect of the present invention includes inserting an insulated wire into a crimp terminal which includes a crimping portion crimp-connecting a conductor portion exposed from the insulated wire including the conductor portion and a cover covering the conductor portion and crimp-connecting the exposed conductor portion of the insulated wire to the crimp terminal. The crimping portion is formed in a hollow cylindrical shape in cross section and has a first end portion and a second end portion opposite to the first end portion. The conductor portion is inserted into the first end portion in a longitudinal direction, and the second end portion is sealed. The second end portion at the opposite side is sealed by welding. The crimping portion, in which the exposed conductor portion is crimped, further includes a locking section locking the exposed conductor portion. A length between the first end portion into which the conductor portion is inserted and a portion, of the locking section, that is the closest to the first end portion is larger than a length of the exposed conductor portion of the insulated wire.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
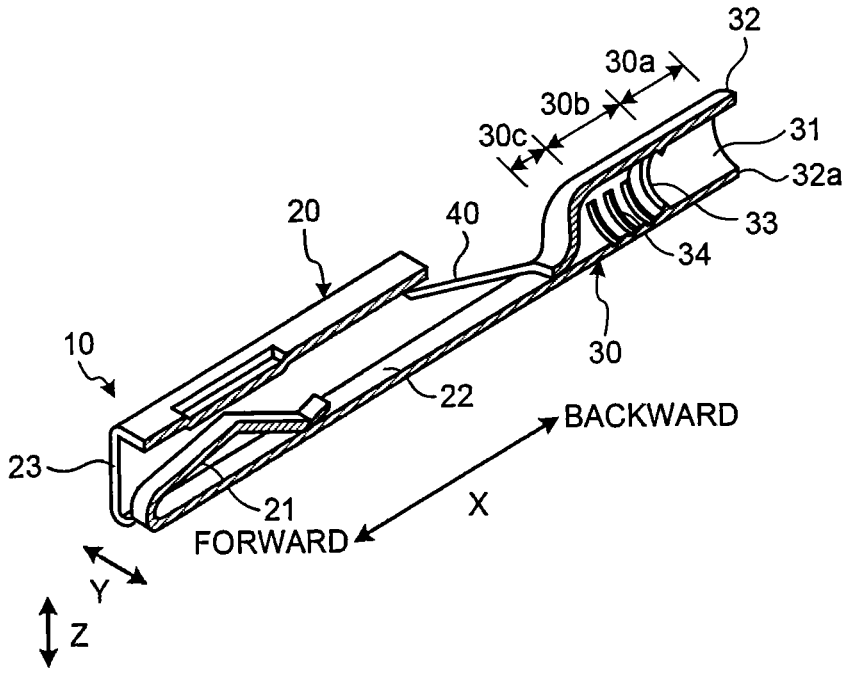
FIG. 1 is a perspective view of a cross section, cut and viewed in the middle of a width direction, of a crimp terminal of a first embodiment of the present invention.

Hereafter, a crimp terminal according to embodiments of the present invention and a method for manufacturing the same will be explained with reference to drawings. The embodiments do not limit the present invention. Also, in each drawing, if deemed appropriate, identical or equivalent elements are given same reference numerals. In addition, it should be noted that the drawings are schematic depictions, and do not represent the actual relation of dimension of each element. Different drawings may include portions using different scales and dimensional relations.

The technology described by Patent Literature 1 needs an additional step of covering the exposed portion of the conductor with an insulator after the insulated wire is crimp-connected. The technology described by Patent Literature 1 requires a lot of effort and time for crimp-connecting of the insulated wire, thereby an efficiency of a step of crimping the insulated wire decreases. From the above described circumstances, a technology has been expected to be developed that is capable of restraining a so-called deterioration of a conductor, i.e. lowering of mechanical strength or lowering of the conductivity of the conductor caused by the corrosion of the conductor caused by the permeation of moisture, by improving sealability to a greater degree without lowering the efficiency of a step of crimping the insulated wire.

In contrast, according to the embodiment described below, it is possible to provide an advantage that a crimp terminal, a crimp-connection structural body, and a method for producing the crimp-connection structural body, that are capable of restraining deterioration of a conductor from being caused by permeation of moisture without lowering the efficiency of a step of crimping of the insulated wire.

A configuration of a crimp terminal as a first embodiment of the present invention will be explained with reference to FIG. 1.

FIG. 1 is a perspective view of a cross section, cut and viewed in the middle of a width direction, of a crimp terminal according to a first embodiment of the present invention. As shown in FIG. 1, the crimp terminal 10 according to the first embodiment of the present invention includes a box section 20 and a crimping portion 30. The box section 20 has a shape of hollow quadrangular prism and is formed as a female crimp terminal. An insertion tab included in a male crimp terminal is inserted into the box section 20 from a front end toward a rear end in the longitudinal direction X. The crimping portion 30 has an approximate O-shape in rear view and is provided at the back of the box section 20 via a predetermined length of transition section 40.

In the present specification, the longitudinal direction X indicates a direction which coincides with a longitudinal direction of an insulated wire crimp-connected by the crimping portion 30, and a width direction Y indicates a direction which is orthogonal to the longitudinal direction X in an approximately horizontal plane. A height direction Z indicates a direction which is approximately orthogonal to an X-Y plane defined by the longitudinal direction X and the width direction Y. In the present specification, a term "forward" indicates an arrow directed from the crimping portion 30 to the box section 20, and a term "backward" indicates an arrow directed from the box section 20 to the crimping portion 30.

Although the crimp terminal 10 is formed as a female crimp terminal, the crimp terminal 10 may be a male crimp terminal including an insertion tab, inserted into and connected to the box section 20, and a crimping portion 30 as long as the crimp terminal 10 is a crimp terminal having the crimping portion 30. The crimp terminal 10 may be a crimp terminal not having a box section nor an insertion tab but having only a plurality of crimping portions 30 for conductors of a plurality of insulated wires to be inserted into, crimped with, and connected integrally respectively.

The crimp terminal 10 is a closed-barrel type of terminal manufactured by punching a copper alloy strip, e.g. a plate of brass or the like of which surface is subjected to a tin-plating (Sn-plating) into a shape of the crimp terminal 10 deployed in plane, bending the copper alloy strip into a 3-dimensional shape of terminal having the box section 20 having a hollow quadrangular prism shape and the crimping portion 30 having an approximate O-shape in rear view, and then welding the crimping portion 30.

The box section 20 is provided with an elastic contact piece 21 being bent toward backward in the longitudinal direction X and contacting the insertion tab of the male crimp terminal. The box section 20 is configured to be of an approximate rectangular shape viewed in front in the longitudinal direction X by bending side parts 23, formed consecutively at both sides of the bottom surface portion 22 in the width direction Y, to overlap each other.

The crimping portion 30 prior to crimping of the insulated wires thereto is approximately O-shaped in rear view by rolling barrel-forming pieces 32, extending at both side of the crimping surface 31 in the width direction Y, so that crimping surfaces 31 come inside and butt welding facing end sections 32*a* of the barrel-forming piece 32 with each other. The length of the barrel-forming piece 32 in the longitudinal direction X is longer than a length of a conductor portion exposed from the insulated wire in the longitudinal direction X.

The crimping portion 30 is of a hollow cylindrical shape including a cover crimping range 30*a* crimping an insulating cover as a cover for the insulated wire, an electric wire crimping range 30*b* crimping an electric wire exposed from the insulated wire, and a sealing portion 30*c* of which front end portion relative to the electric wire crimping range 30*b* is crushed to be deformed in a substantial planar shape at an opposite side to the cover crimping range 30*a*. Formed on an inner surface of the crimping portion 30 are protrusive guide sections 33 on an entire inner circumference of the crimping portion 30 and a plurality of electric-wire-locking grooves 34 extending in a Y-Z plane and being disposed along the longitudinal direction X with a predetermined interval.

To be more specific, the guide section 33 is formed to be an annular protrusion at a border of the cover crimping range 30*a* and the electric wire crimping range 30*b* in the crimping portion 30. Although the guide section 33 according to the present embodiment is formed in an annular shape on the entire inner circumference of the crimping portion 30, the guide section 33 may not have to be formed on the entire circumference. For example, guide sections may be formed separately in two or more areas along the inner circumference. Herein it is configured that the center of a circle, or an apex of a central angle of a circular arc, determined by an inner diameter of the guide section 33 crosses a central axis of a cylinder formed by the crimping portion 30 in parallel with the X direction substantially.

Formed on the inner surface of the electric wire crimping range 30*b* are three electric-wire-locking grooves 34 (called serration) as locking portions in the longitudinal direction X with a predetermined interval. An electric wire exposed from the insulated wire in a crimped state cuts into the electric-wire-locking groove 34. The electric-wire-locking groove 34 is formed in a rectangular recessed shape viewed in cross section. The electric-wire-locking groove 34 formed from the crimping surface 31 to halfway to the barrel-forming piece 32 improves conductivity between the crimping portion 30 and the electric wire because the electric wire exposed from the insulated wire cuts into the electric-wire-locking groove 34. The electric-wire-locking groove may be formed continuously within a range between the crimping surface 31 and the barrel-forming piece 32, i.e. an annular groove in the crimping portion 30. Although the electric-wire-locking groove 34 is formed as a groove, a state of the locking portion is not limited to a groove, and for example, round holes or rectangular holes (recess portions) may be disposed separately.

Figure 2A:
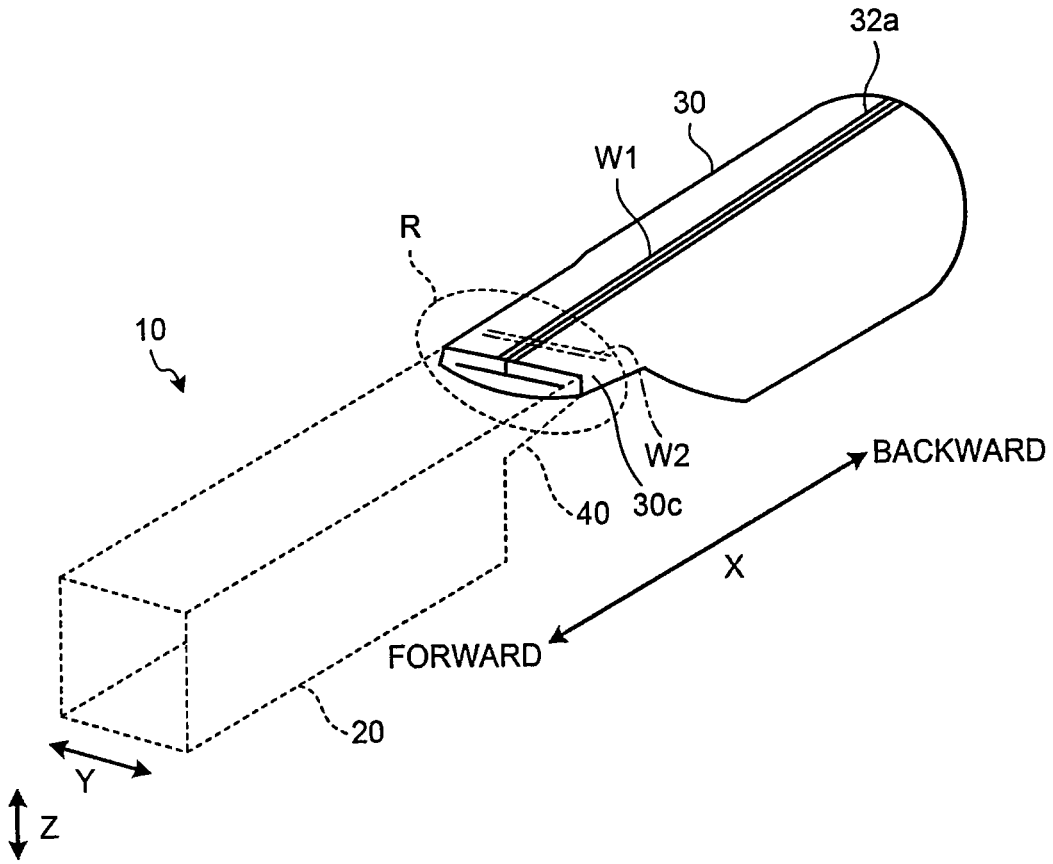
FIG. 2A is a schematic isometric view, of a bottom surface side of the crimp terminal, seeing through a box section of the crimp terminal shown in FIG. 1.
Figure 2B:
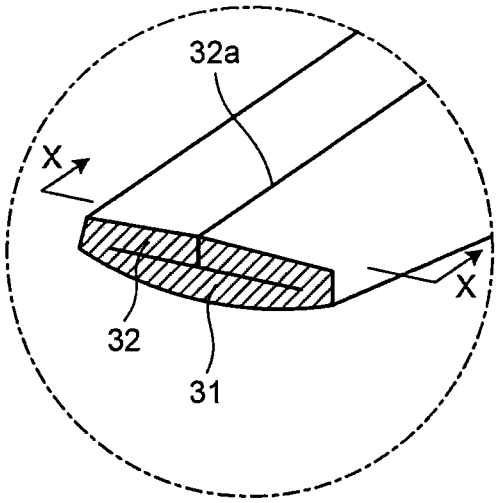
FIG. 2B is an enlarged view of an area shown in FIG. 2A.
Figure 2C:
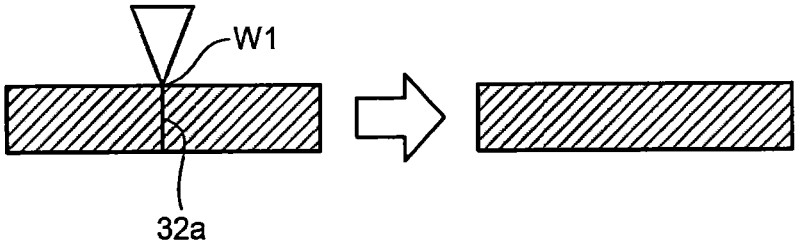
FIG. 2C is an X-X cross sectional view of a portion around facing end sections shown in FIG. 2B.
Figure 3:
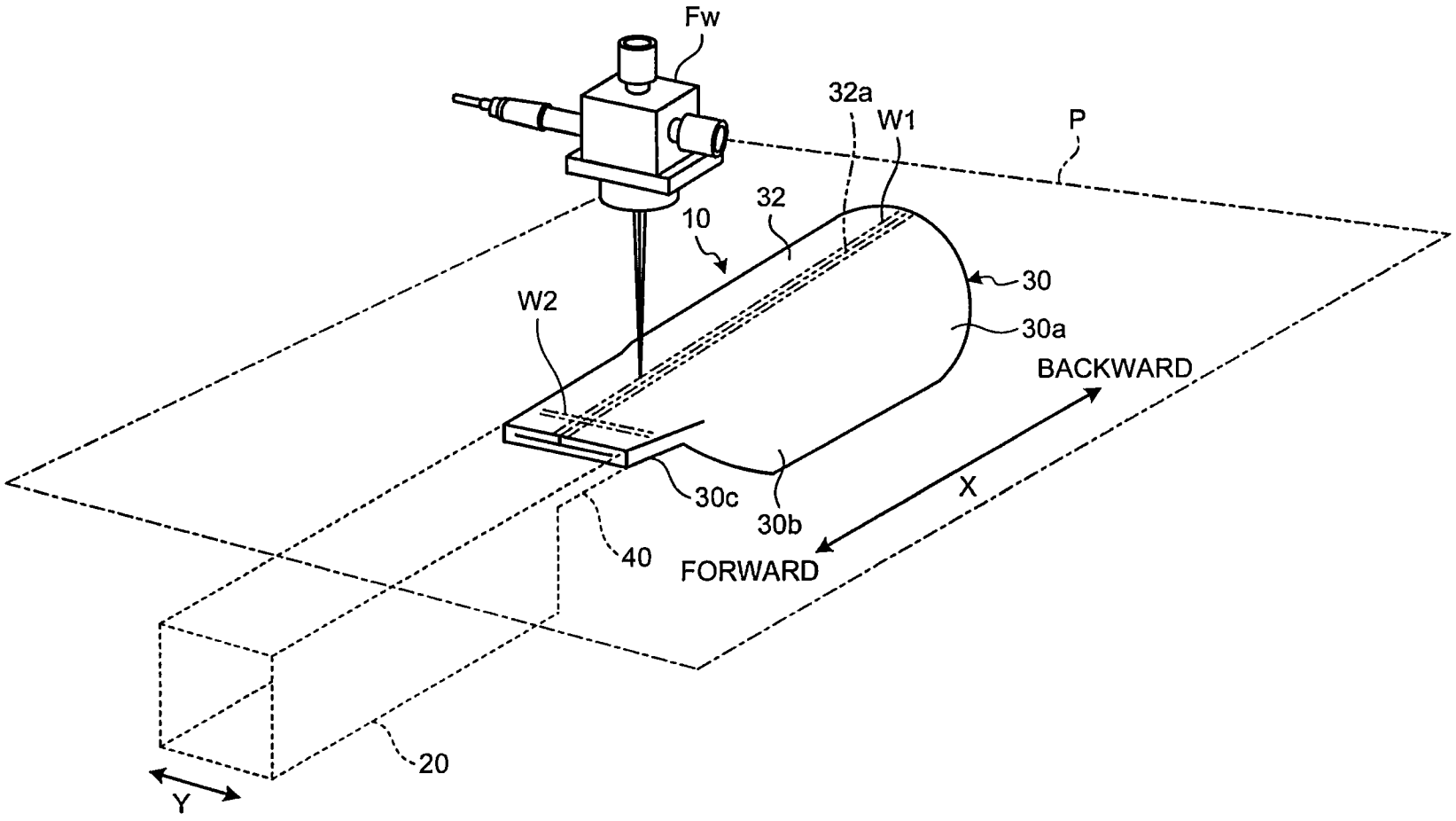
FIG. 3 illustrates a method for welding the crimping portion.

Next, a method for manufacturing the crimp terminal 10 shown in FIG. 1 will be explained with reference to FIGS. 2A to 2C and FIG. 3. FIG. 2A is a schematic isometric view of a bottom surface side of the crimp terminal 10 seeing through the box section 20 of the crimp terminal 10. FIG. 2B is an enlarged view of an area R shown in FIG. 2A. FIG. 2C is an X-X cross sectional view of a portion around facing end sections 32*a* shown in FIG. 2B. FIG. 3 illustrates a method for welding the crimping portion 30.

The crimp terminal 10 is manufactured by punching a copper alloy strip into a shape of a terminal deployed in plane, bending the punched copper alloy strip into a 3-dimensional shape of the terminal having the box section 20 having a hollow quadrangular prism shape and the crimping portion 30 having an approximate O-shape in rear view, and then welding the crimping portion 30. Herein as shown in FIG. 2A, the crimping portion 30 is formed by welding a longitudinal direction welding point W1, by butting facing end sections 32*a* of the barrel-forming piece 32 in the longitudinal direction X, and a width-directional welding point W2, being made in the width direction Y and sealing a front end of the sealing portion 30*c* of the crimping portion 30 completely.

To be more specific, the production of the crimping portion 30 begins with butting the facing end sections 32*a* at a bottom surface side so that the crimping surface 31 and the barrel-forming piece 32 are rolled to constitute a cylindrical shape. After that, as shown in FIG. 2B, an upper side of a cylindrical front portion is pushed to a bottom side of the cylindrical front portion to be deformed in a substantial planar shape. After that, as shown in FIG. 2C, the longitudinal direction welding point W1, in which the cylindrical facing end sections 32*a* are butted with each other, is welded, and after that the width-directional welding point W2 is welded. Since the longitudinal direction welding point W1 and the width-directional welding point W2 are disposed to be on a plane that is the same as a virtual plane P shown in FIG. 3, the longitudinal direction welding point W1 and the width-directional welding point W2 can be welded by a monofocal laser welding.

As shown in FIG. 3, the longitudinal direction welding point W1 and the width-directional welding point W2 are welded by fiber laser welding using a fiber laser welding device Fw. The fiber laser welding indicates a welding using fiber laser light at an approximately 1.08 μm of wavelength. Since the fiber laser light is an ideal Gaussian beam and can be condensed to a diffraction limit, equal to or smaller than 30 μm of focused spot diameter can be configured, which could not be achieved by YAG laser or $CO_2$ laser. Therefore, welding with a high energy density can be achieved easily.

Since the longitudinal direction welding point W1 and the width-directional welding point W2 are welded by the fiber laser welding as described above, the crimping portion 30 can be configured to have a sealability against moisture. Hereby the conductor portion of the insulated wire crimp-connected by the crimping portion 30 is not exposed to open air, it is possible to restrain deterioration and chronological change of the conductor portion from occurring. Therefore, since corrosion of the conductor portion does not occur and an increase in an electric resistance causing corrosion can be prevented, a stable conductivity can be achieved.

Conducting the above-described welding by the fiber laser welding allows a gap-less crimping portion 30 to be configured, and is capable of preventing permeation of moisture into the crimped state of crimping portion 30 reliably and improving sealability against moisture. In comparison with other laser welding, the fiber laser welding is capable of focusing a laser to an extremely small spot to achieve a higher output of the laser welding and a continuous irradiation. Therefore, adapting the fiber laser welding enables fine processing and continuous processing to the extremely small crimp terminal 10 while restraining a laser mark from occurring. Accordingly, welding can be conducted with a reliable sealability against moisture.

Hereafter, a structure inside the crimping portion 30 and a configuration of the insulated wire will be explained more specifically with reference to FIGS. 4A to 4C.

Figure 4A:
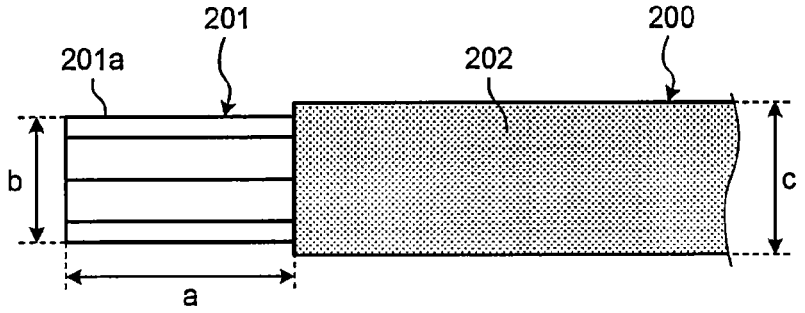
FIG. 4A illustrates a configuration of an insulated wire.

FIG. 4A illustrates a configuration of an insulated wire to be crimp-connected to the crimp terminal 10. As shown in FIG. 4A, an insulated wire 200 includes an aluminum core wire 201 as a conductor portion and an insulating cover 202 covering the aluminum core wire 201. When crimp-connecting the insulated wire 200 to the crimp terminal 10, the insulating cover 202 in an end area is removed to form an electric-wire-exposed part 201*a* as an exposed conductor portion. Herein "a" indicates a length of the electric-wire-exposed part 201*a*, "b" indicates an outer diameter of the aluminum core wire 201 (electric-wire-exposed part 201*a*), and "c" indicates an outer diameter of the insulated wire 200 (i.e. b<c).

Figure 4B:
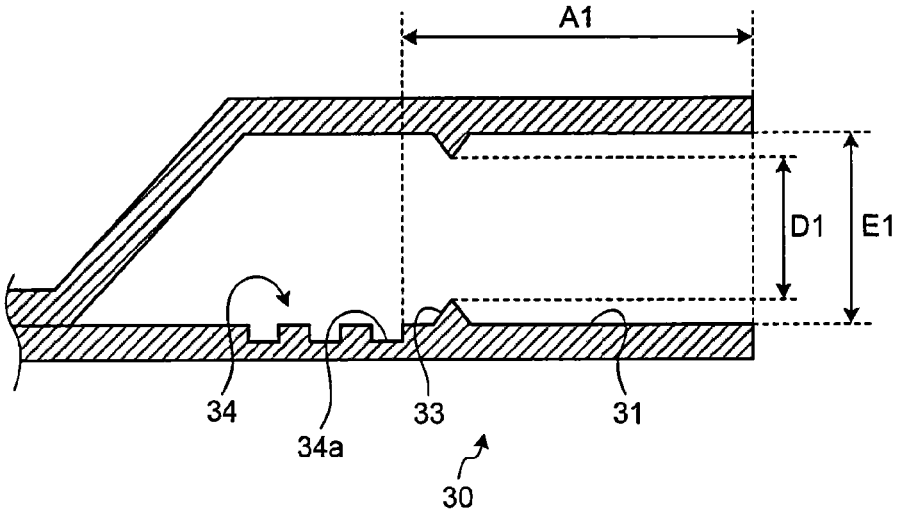
FIG. 4B is an X-Z cross sectional view of the crimping portion of the crimp terminal shown in FIG. 1.
Figure 4C:
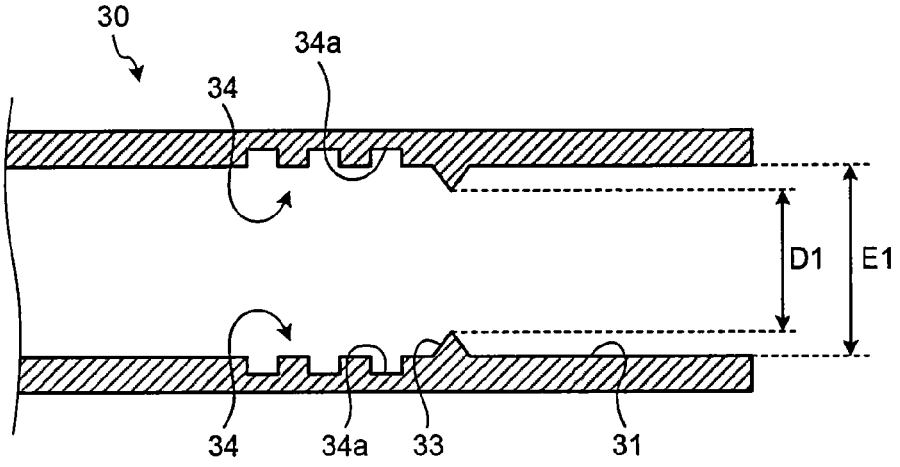
FIG. 4C is an X-Y cross sectional view of the crimping portion of the crimp terminal shown in FIG. 1.

FIG. 4B is an X-Z cross sectional view of the crimping portion 30 of the crimp terminal 10. FIG. 4C is an X-Y cross sectional view of the crimping portion 30 of the crimp terminal. Herein "E1" indicates an inner diameter of a rear end portion of the cover crimping range 30*a*, as an end portion into which the insulated wire 200 is inserted, of the crimping portion 30 in the X direction, and "D1" indicates an inner diameter (the smallest inner diameter) formed by the guide section 33. To be more specific, in the first embodiment, the inner diameter D1 is, for example, 2.5 mm, and the inner diameter E1 is, for example, 3.1 mm. In addition, "A1 " indicates a length between a rear end portion of the cover crimping range 30*a*, in the X direction as an end portion into which the insulated wire 200 is inserted, and an end portion of an electric-wire-locking groove 34*a*, at the side of the cover crimping range 30*a*, that is the closest to the rear end portion among the electric-wire-locking grooves 34. The border between the area in which the electric-wire-exposed part 201*a* is crimped and the area of which diameter is reduced at the sealed side in the hollow cylindrical shape in cross section coincides approximately with a position at which an electric wire is inserted and disposed and at which the end of the electric-wire-exposed part 201*a* reaches. Herein in the first embodiment, to be more specific, the length A1 is, for example, 4.2 mm.

Figure 5A:
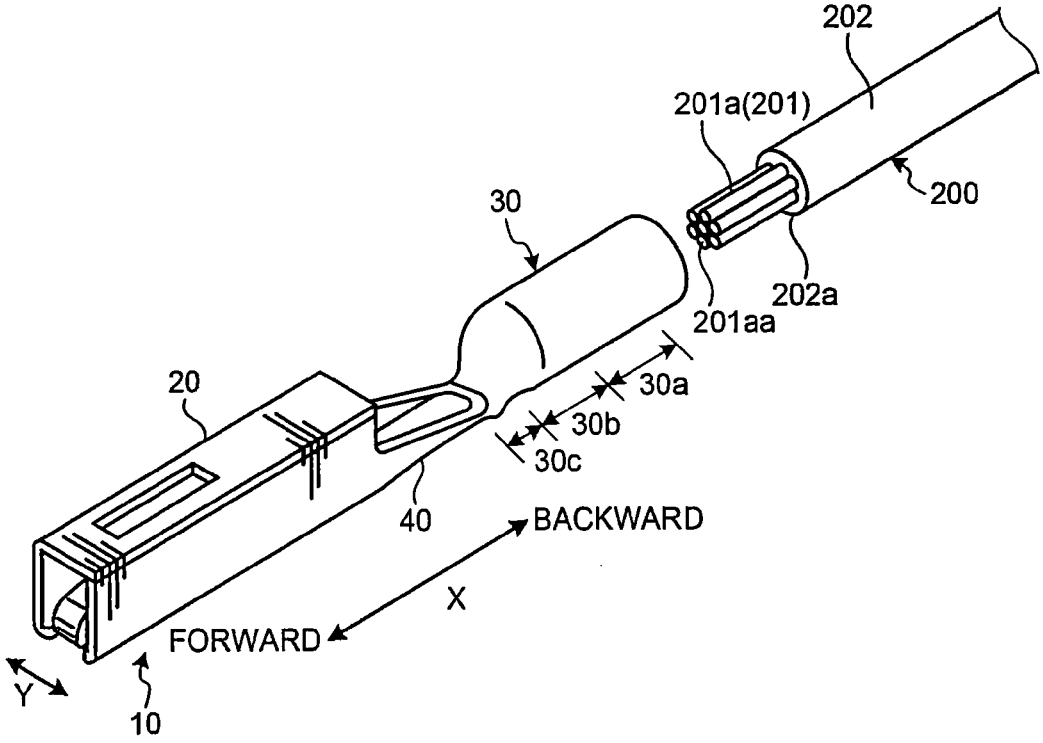
FIG. 5A is a perspective view showing a previous state of crimp-connecting the insulated wire to the crimp terminal shown in FIG. 1.
Figure 5B:
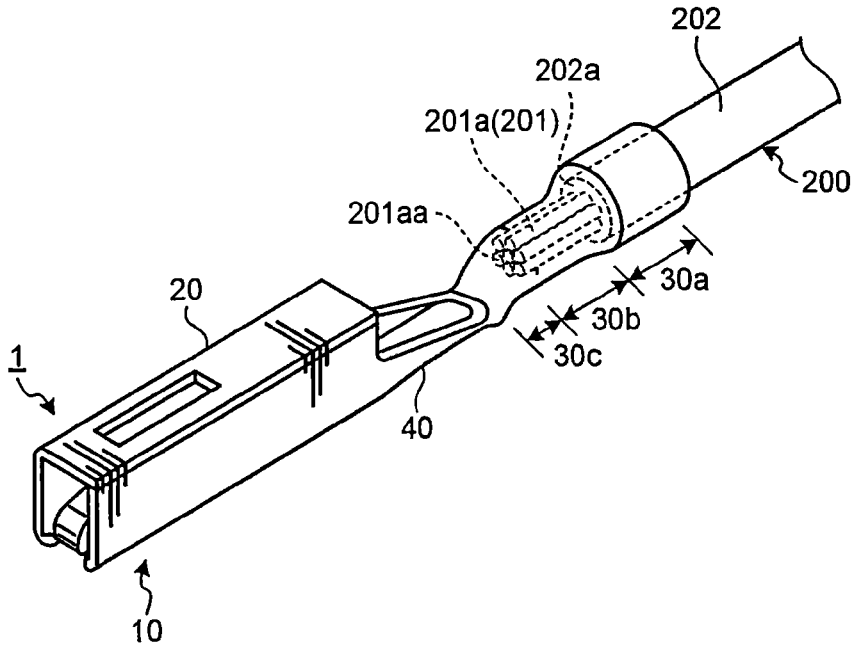
FIG. 5B is a perspective view showing a subsequent state of crimp-connecting the insulated wire to the crimp terminal shown in FIG. 1.

Hereafter a method for manufacturing a crimp-connection structural body will be explained. FIGS. 5A and 5B are perspective views showing respectively states of prior to and subsequent to crimping and connecting an insulated wire to the crimp terminal shown in FIG. 1. As shown in FIGS. 5A and 5B, when crimp-connecting the insulated wire to the above-described crimp terminal 10, the electric-wire-exposed part 201*a* of the aluminum core wire 201, exposed at an end side relative to the insulating cover 202, of the insulated wire 200 is inserted into, and disposed at, the crimping portion 30 so that a position of the end 201*aa* of the electric-wire-exposed part 201*a* in the longitudinal direction X is backward more than the sealing portion 30*c* of the crimping portion 30. After that, the crimping portion 30 crimps, and covers integrally, from the end 201*aa* of the electric-wire-exposed part 201*a* to a somewhat backward relative to the cover end 202*a* of the insulating cover 202. Hereby the crimping portion 30 crimps, in a tight contact state, the insulating cover 202 of the insulated wire 200 and a circumferential surface of the electric-wire-exposed part 201*a* of the aluminum core wire 201. Hereby the crimp-connection structural body 1 is manufactured.

As described above, the longitudinal direction welding point W1 and the width-directional welding point W2 are welded in the crimp terminal 10 according to the first embodiment of the present invention. Therefore the insulated wire 200 in the crimped state achieves sealability against moisture, i.e., water does not permeate into a front side of the crimping portion 30 and outside of the crimping portion 30. Since the electric wire crimping range 30*b* is sealed by the insulating cover 202 of the insulated wire 200 and the guide section 33 shown in FIGS. 4B and 4C, sealability against moisture from backward of the crimping portion 30 is also improved. Hereby water does not contact a portion at which the electric-wire-exposed part 201*a* of the aluminum core wire 201 of the insulated wire 200 in the crimped state makes a tight contact with an inner surface of the crimping portion 30.

The aluminum core wire 201 is made of an aluminum-based material, and the crimping portion 30 is made of a copper-based material. Hereby it is possible to achieve a reduced weight in comparison with an insulated wire having a copper-made core wire. As a result of this, since corrosion of the aluminum core wire 201 does not occur, and thus, an electric resistance does not increase due to such corrosion, the conductivity of the aluminum core wire 201 becomes stable. As a result, it is possible to connect the aluminum core wire 201, e.g., a twisted wire, a single wire, or a rectangular wire or the like to the crimping portion 30 of the crimp terminal 10 reliably and tightly.

Figure 6:
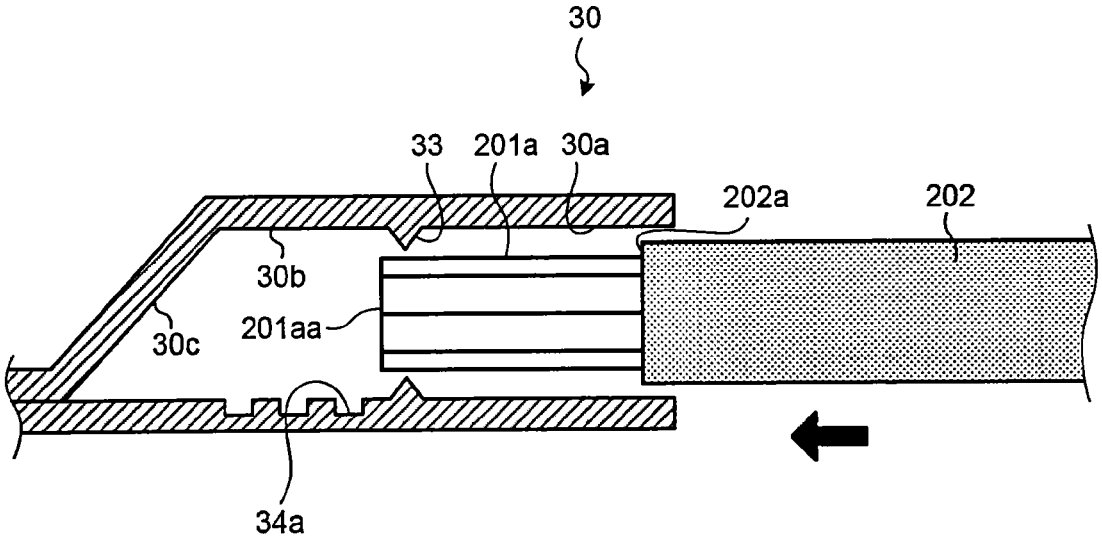
FIG. 6 illustrates a state of inserting the insulated wire into the crimping portion of the crimp terminal shown in FIG. 1.

FIG. 6 illustrates a state of inserting the insulated wire 200 into the crimping portion 30 of the crimp terminal 10. Herein, in the crimping terminal 30, the length (length A1 in FIG. 4B) between the rear end portion of the cover crimping range 30*a* in the X direction as the end portion into which the insulated wire 200 is inserted and an end portion of an electric-wire-locking groove 34*a*, at the side of the cover crimping range 30*a*, that is the closest to the rear end portion among the electric-wire-locking grooves 34 is longer than the length of the electric-wire-exposed part 201*a* (length a in FIG. 4A) (i.e., a<A1). As a result of that, when inserting the insulated wire 200 into the crimping portion 30, the end 201*aa* of the electric-wire-exposed part 201*a* is inserted at first into the rear end portion of the cover crimping range 30*a* in the X direction, and the cover end 202*a* of the insulating cover 202 is inserted into the rear end portion of the cover crimping range 30*a* in the X direction before the end 201*aa* reaches the electric-wire-locking groove 34*a*. Herein at the time of the above-described insertion, it is preferable that a central axis passing through the center of a circular cross section, which is orthogonal to the X direction, of the insulated wire 200 and being in parallel with the X-direction coincides substantially with a central axis, which is in parallel with the X direction, of the crimping portion 30. After that, the end 201*aa* reaches the electric-wire-locking groove 34*a*.

Hereby the insulated wire 200 is guided by the cover crimping range 30*a* of which inner diameter is E1, and thus, the orientation of the insulated wire 200 is regulated. As a result of that, an inclination of the insulated wire 200 decreases, and accordingly, the orientation of the insulated wire 200 becomes more suitable for an inserting operation. To be more specific, the insertion is conducted so that the central axis of the insulated wire 200 is in parallel with the longitudinal direction (X direction) of the crimping portion 30 of the crimp terminal 10. As described above, the end 201*aa* subsequent to be in the orientation suitable for insertion reaches the electric-wire-locking groove 34*a*, an event is prevented that the end 201*aa* of the electric-wire-exposed part 201*a* is caught by the electric-wire-locking groove 34 to be deformed. Hereby, an operation of inserting the insulated wire 200 can be conducted stably, thus, an efficiency of a step of crimping of the insulated wire 200 is prevented from decreasing.

In addition to a guide such as the above-described cover crimping range 30*a*, a protrusive guide section 33 having a tapered section from backward to forward on a rear inner surface relative to the electric-wire-locking groove 34*a* may be provided. Since the tapered section is provided at the side of the cover crimping range 30*a* of the guide section 33, the electric-wire-exposed part 201*a* is inserted into the electric wire crimping range 30*b* more smoothly. Herein "E1 " indicates the inner diameter of the rear end portion of the cover crimping range 30*a*, as an end portion into which the insulated wire 200 is inserted, of the crimping portion 30 in the X direction, and "D1 " indicates the inner diameter formed by the guide section 33. The inner diameter E1 at the rear end portion of the cover crimping range 30*a* in the X direction is larger than an outer diameter c of the insulated wire 200, i.e., b<c<E1. Hereby it is possible to improve operability and working efficiency when inserting the insulated wire 200 into the crimp terminal 10 as explained above.

The inner diameter D1 defined by the guide section 33 of the crimping portion 30 is larger than an outer diameter b of the electric-wire-exposed part 201*a*, and an outer diameter c of the insulated wire 200 is larger than the inner diameter D1 (i.e., b<D1 <c). Since, hereby the cover end 202*a* of the insulating cover 202 enters not deeper than the guide section 33, a quality of electric connection becomes stable between the aluminum core wire 201 and the crimp terminal 10.

In the crimping portion 30, a difference between the inner diameter D1 formed by the guide section 33 and the outer diameter b of the electric-wire-exposed part 201*a* (i.e., a gap produced at the time of insertion between the guide section 33 and the electric-wire-exposed part 201*a*) is larger than a difference between the inner diameter E1 of the cover crimping range 30*a* and the outer diameter c of the insulated wire 200 (i.e., a gap produced at the time of insertion between the cover crimping range 30*a* and the insulating cover 202 of the insulated wire 200) (i.e., E1−c<D1−b). Hereby since, even if the orientation of the insulated wire 200 is regulated by the cover crimping range 30*a*, a clearance is obtained between the guide section 33 and the electric-wire-exposed part 201*a*, an event is prevented more reliably that the end 201*aa* of the electric-wire-exposed part 201*a* is caught by the electric-wire-locking groove 34 to be deformed.

Alternatively, the crimp-connection structural body 1 configured as above can configure a wire harness by providing at least a combination of the crimp terminal 10 and the insulated wire 200 as shown in FIG. 5B.

Figure 7:
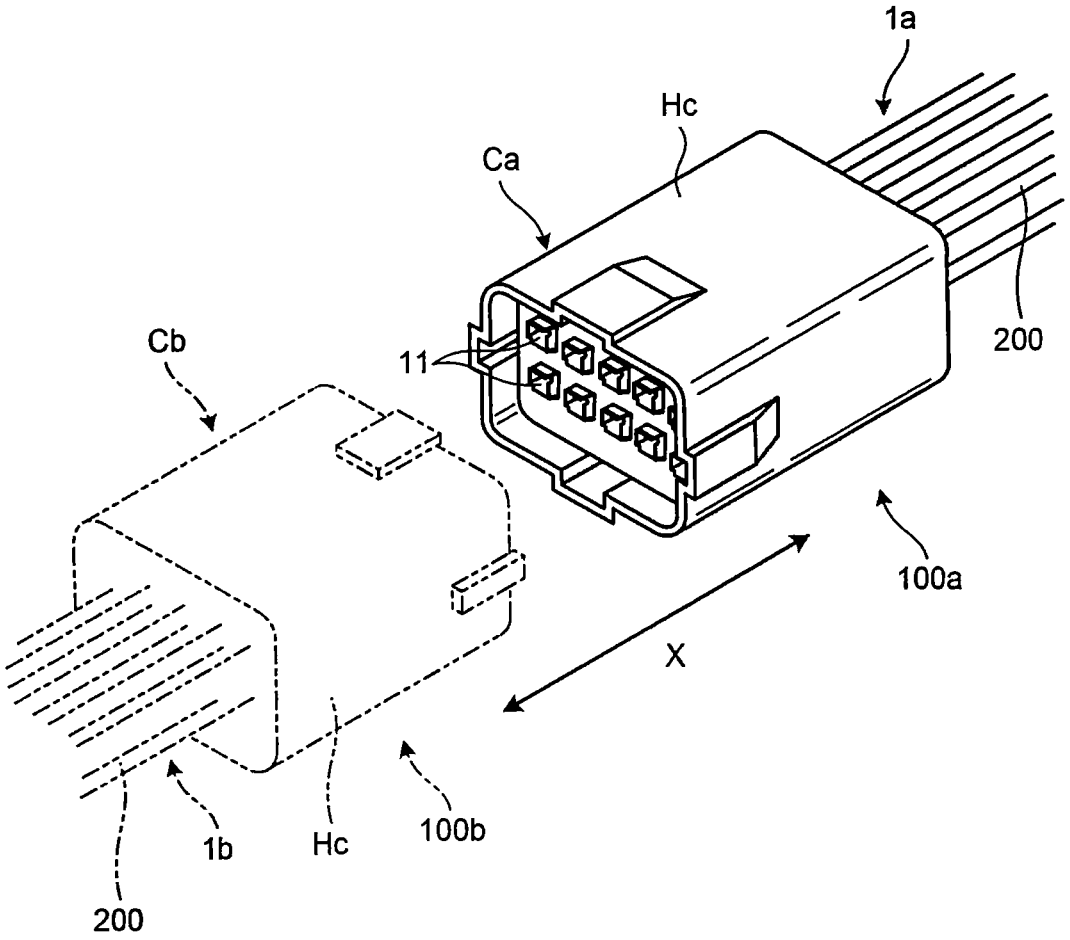
FIG. 7 is a perspective view of a connected portion of the wire harness using the crimp terminal of the first embodiment of the present invention.

Meanwhile, a wire harness can be configured by attaching a connector to the crimp-connection structural body 1. To be more specific, FIG. 7 is a perspective view showing a connector in which the above-configured wire harnesses are attached to a pair of connector housings. As shown in FIG. 7, a crimp-connection structural body 1*a* using the female crimp terminal 11 as the crimp terminal 10 and the crimp-connection structural body 1*b* using the male crimp terminal (not shown) as the crimp terminal 10 are attached to a pair of the connector housings Hc respectively. It is possible to configure a female connector Ca and a male connector Cb having reliable conductivities by attaching the crimping structural bodies 1*a* and 1*b* to the pair of the connector housings Hc respectively.

To be more specific, a wire harness 100*a* provided with the female connector Ca is configured by attaching the crimp-connection structural body 1*a* configured to have the female crimp terminal 11 to the female connector housing Hc. A wire harness 100*b* provided with the male connector Cb is configured by attaching the crimp-connection structural body 1*b* configured to have the male crimp terminal (not shown) to the male connector housing Hc. The wire harnesses 100*a* and 100*b* can be connected electrically and physically by fitting the male connector Cb to the female connector Ca along the X direction.

Figure 8A:
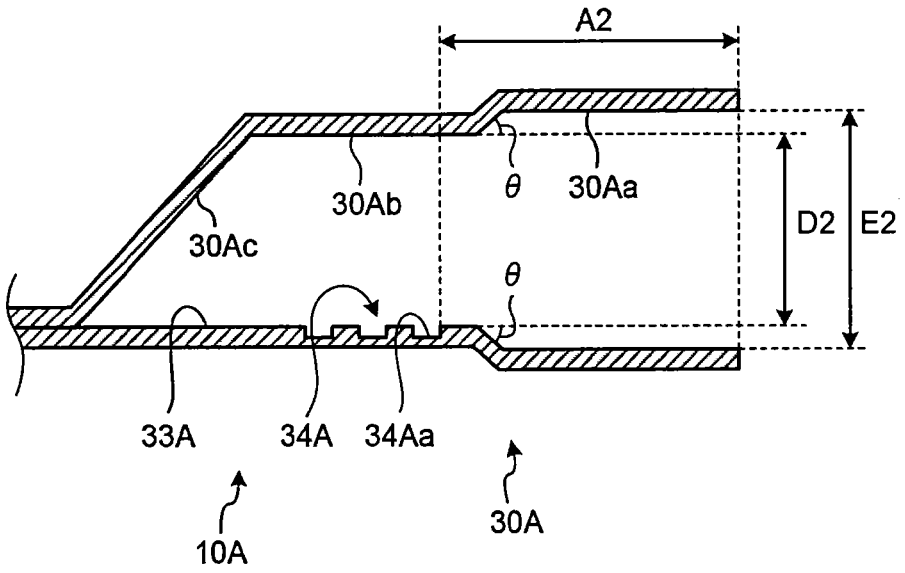
FIG. 8A is a cross-sectional view of a crimping portion of a crimp terminal of a second embodiment of the present invention.
Figure 8B:
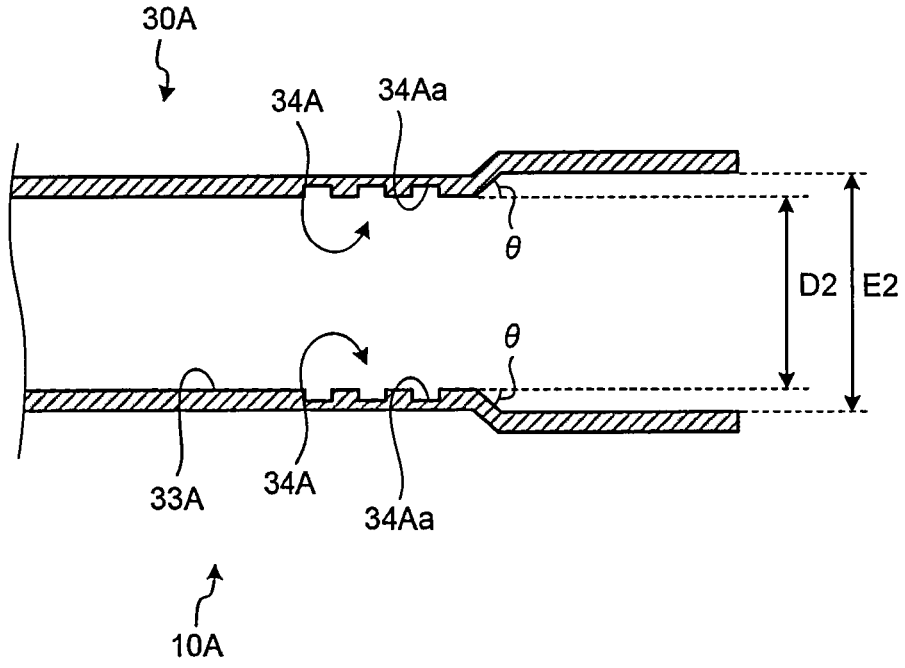
FIG. 8B is a cross-sectional view of a crimping portion of a crimp terminal of the second embodiment of the present invention.

FIG. 8A is a cross-sectional view of a crimping portion of a crimp terminal of a second embodiment of the present invention. FIG. 8B is a cross-sectional view of the crimping portion of the crimp terminal of the second embodiment of the present invention. FIGS. 8A and 8B are cross-sectional views corresponding to FIGS. 4B and 4C as the cross-sectional views of the crimp terminal 10. A box section of a crimp terminal 10A shown in FIGS. 8A and 8B has a configuration that is similar to that of the box section 20 of the crimp terminal 10 shown in FIG. 1, and therefore, an explanation therefor is omitted.

Similarly to the crimping portion 30 of the crimp terminal 10, a crimping portion 30A shown in FIG. 8A includes a cover crimping range 30Aa, an electric wire crimping range 30Ab, and a sealing portion 30Ac. Herein an inner diameter of the electric wire crimping range 30Ab is smaller than that of the cover crimping range 30Aa, and serves as a guide section (hereafter the cover crimping range 30Aa may be described as guide section 33A). Herein it is configured that a central axis in parallel with a cylinder being formed by the guide section 33A in the X direction coincides substantially with a central axis in parallel with a cylinder being formed by the crimping portion 30A in the X direction. The crimping portion 30A is provided with an electric-wire-locking groove 34A at the electric wire crimping range 30Ab (guide section 33A).

In the crimping portion 30A, "E2" indicates an inner diameter of a rear end portion of the cover crimping range 30Aa in the X direction as an end portion into which the insulated wire 200 is inserted, and "D2" indicates an inner diameter of the guide section 33A. In the second embodiment, to be more specific, the inner diameter D2 is, for example, 2.5 mm, and the inner diameter E2 is, for example, 3.1 mm. In addition, "A2" indicates a length between the rear end portion of the cover crimping range 30Aa in the X direction as the end portion into which the insulated wire 200 is inserted and an end portion of an electric-wire-locking groove 34Aa, at the side of the cover crimping range 30Aa, that is the closest to the rear end portion among the electric-wire-locking grooves 34A. Herein, in the second embodiment, the length A2 is, for example, 4.2 mm. The inner diameter E2 of the rear end portion of the cover crimping range 30Aa in the X direction is larger than the outer diameter c of the insulated wire 200, i.e., b<c<E2. Hereby it is possible to improve operability and working efficiency when inserting the insulated wire 200 into the crimp terminal 10A.

Herein, similarly to the crimping portion 30, in the crimping terminal 30A, the length A2 between the rear end portion of the cover crimping range 30Aa in the X direction and an end portion of the electric-wire-locking groove 34Aa at the side of the cover crimping range 30Aa is larger than the length a of the electric-wire-exposed part 201*a* (i.e., a<A2). As a result of that, when inserting the insulated wire 200 into the crimping portion 30A, the end 201*aa* of the electric-wire-exposed part 201*a* is inserted into the rear end portion of the cover crimping range 30Aa in the X direction at first, and the cover end 202*a* of the insulating cover 202 is inserted into the rear end portion of the cover crimping range 30Aa in the X direction before the end 201*aa* reaches an electric-wire-locking groove 34Aa. Herein at the time of the above-described insertion, it is preferable that a central axis of the insulated wire 200 coincides substantially with a central axis which is in parallel with the X direction of the crimping portion 30A. After that, the end 201*aa* reaches the electric-wire-locking groove 34Aa.

Hereby the insulated wire 200 is guided by the cover crimping range 30Aa of which inner diameter is E2, and thus, the orientation of the insulated wire 200 is regulated. As a result, the orientation of the insulated wire 200 becomes less inclined, thus more suitable for an inserting operation. Since the end 201*aa* having been in the orientation suitable for insertion reaches the electric-wire-locking groove 34Aa, an event is prevented that the end 201*aa* of the electric-wire-exposed part 201*a* is caught by the electric-wire-locking groove 34A to be deformed. Hereby, an operation of inserting the insulated wire 200 can be conducted stably, thus, an efficiency of a step of crimping of the insulated wire 200 is prevented from decreasing.

Since a tapered section is provided at a side of the cover crimping range 30Aa of the guide section 33A, the electric-wire-exposed part 201*a* is inserted into the electric wire crimping range 30Ab more smoothly. Herein from a view point of restraining the electric-wire-exposed part 201*a* from being caught by the tapered section and for achieving a more smooth insertion, it is preferable that an angle θ defined by the tapered section of the guide section 33A relative to the X direction is equal to or smaller than 45°.

In the crimping portion 30A, similarly to the crimping portion 30, the inner diameter D2 of the guide section 33A is larger than the outer diameter b of the electric-wire-exposed part 201*a*, and the outer diameter c of the insulated wire 200 is larger than the inner diameter D2 (i.e., b<D2<c). Since, hereby the cover end 202*a* of the insulating cover 202 enters not deeper than the guide section 33A, a quality of electric connection becomes stable between the aluminum core wire 201 and the crimp terminal 10A.

In the crimping portion 30A, similarly to the crimping portion 30, a difference between the inner diameter D2 formed by the guide section 33A and the outer diameter b of the electric-wire-exposed part 201*a* is larger than a difference between the inner diameter E2 of the cover crimping range 30Aa and the outer diameter c of the insulated wire 200 (i.e., E2−c<D2−b). Hereby since, even if the orientation of the insulated wire 200 is regulated by the cover crimping range 30Aa, a clearance is obtained between the guide section 33A and the electric-wire-exposed part 201*a*, an event is prevented more reliably that the end 201*aa* of the electric-wire-exposed part 201*a* is caught by the electric-wire-locking groove 34A to be deformed. In addition, as described above, since it is possible to control a positional relationship between the crimping portion 30A and the insulated wire 200 in an operation of insertion, it is possible to achieve a stable sealability of the crimped crimp terminal 10A against moisture.

Figure 9:
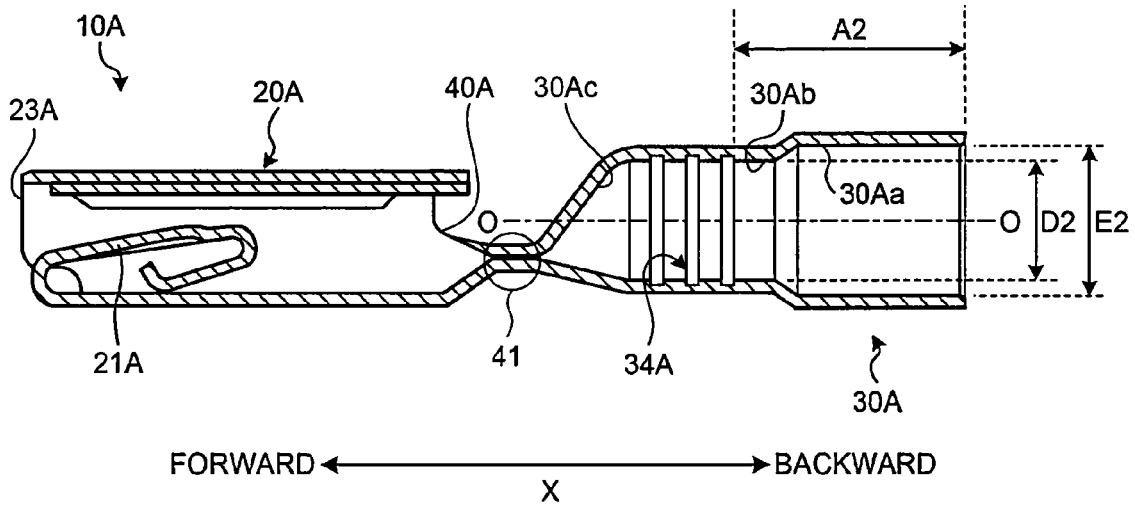
FIG. 9 is a cross-sectional view showing another example of the crimp terminal of the second embodiment of the present invention.

Hereafter a modification example of the crimp terminal according to the above-described second embodiment will be explained. FIG. 9 is a cross-sectional view showing another example of the crimp terminal 10A of the second embodiment.

Similarly to the first embodiment and the second embodiment, as shown in FIG. 9, the crimp terminal 10A according to the modification example includes a box section 20A and a crimping portion 30A. The box section 20A has a shape of hollow quadrangular prism. An insertion tab included in a male crimp terminal is inserted into the box section 20A from a front end side toward a rear end in the longitudinal direction X. The crimping portion 30A has an approximate O-shape in rear view and is provided at the back of the box section 20A via a predetermined length of transition section 40A. The box section 20A is provided with an elastic contact piece 21A being bent backward in the longitudinal direction X and contacting the insertion tab of the male crimp terminal. The box section 20A is configured to be of an approximate rectangular shape viewed in front in the longitudinal direction X by bending side parts 23A to overlap each other.

Unlike the second embodiment, the crimp terminal 10A has a shift-neck portion 41 in which a connection portion of a part between the sealing portion 30Ac and the transition section 40A is shifted to a side of a central axis O of the crimping portion 30A relative to a bottom surface of the electric wire crimping range 30Ab. Since an area inclining in a bent part is shorter than that of the crimp terminal 10 according to the first embodiment by providing the shift-neck portion 41, the entire length along the longitudinal direction X can be decreased; thus, the crimp terminal 10A can be downsized. Since the connection portion of the shift-neck portion 41 is bent, an act of support occurs at the connection portion. Thus, the shift-neck portion 41 is supported even if external forces are applied in a vertical direction (Z direction) and in a lateral direction (Y direction), strength thereof can be increased. Other configurations are similar to that of the crimp terminal 10A according to the second embodiment, explanations therefor will be omitted.

Figure 10A:
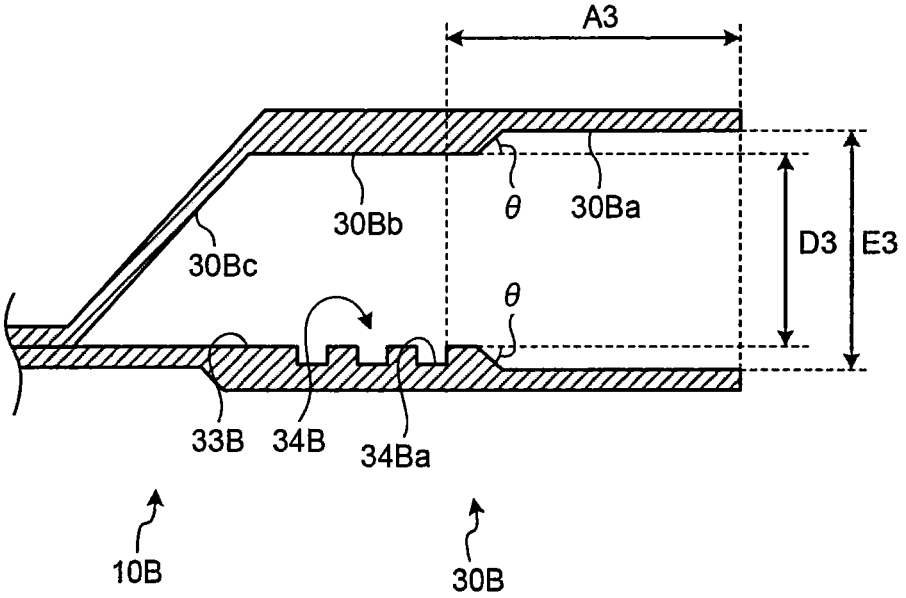
FIG. 10A is a cross-sectional view of a crimping portion of a crimp terminal of a third embodiment of the present invention.
Figure 10B:
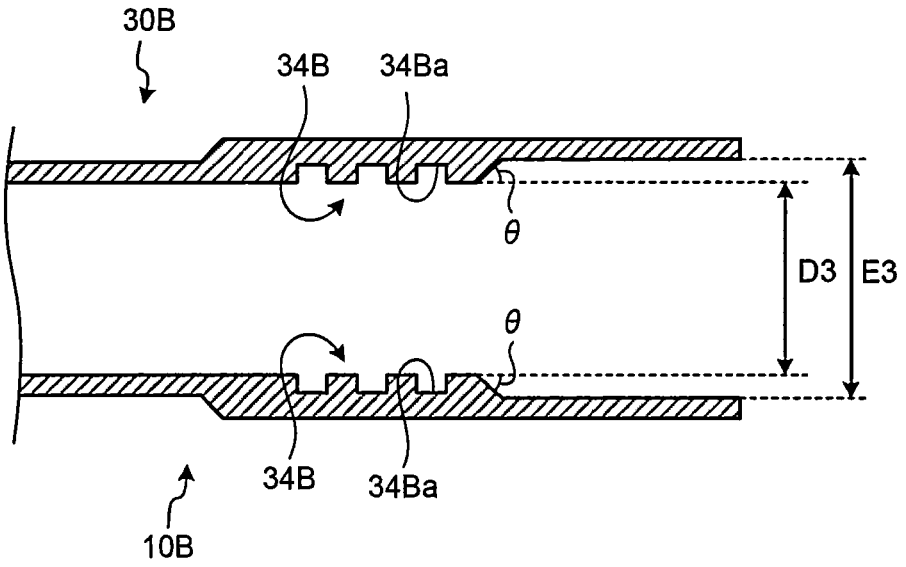
FIG. 10B is a cross-sectional view of the crimping portion of the crimp terminal of the third embodiment of the present invention.

FIG. 10A is a cross-sectional view of a crimping portion of a crimp terminal of a third embodiment of the present invention. FIG. 10B is a cross-sectional view of the crimping portion of the crimp terminal of the third embodiment. FIGS. 10A and 10B are cross-sectional views corresponding to FIGS. 8B and 8. The box section of the crimp terminal 10B shown in FIGS. 10A and 10B has a configuration which is similar to that of the box section 20 of the crimp terminal 10 shown in FIG. 1, explanation therefor will be omitted.

Similarly to the crimping portions 30 and 30A, a crimping portion 30B includes a cover crimping range 30Ba, an electric wire crimping range 30Bb, and a sealing portion 30Bc. Herein although outer diameters of the electric wire crimping range 30Bb and the cover crimping range 30Ba are substantially the same, a thickness of the electric wire crimping range 30Bb is larger than a thickness of the cover crimping range 30Ba. Hereby since the inner diameter of the electric wire crimping range 30Bb is smaller than the inner diameter of the cover crimping range 30Ba, the electric wire crimping range 30Bb serves as a guide section (hereafter the cover crimping range 30Ba may be described as guide section 33B). The crimping portion 30B is provided with an electric-wire-locking groove 34B at the electric wire crimping range 30Bb (guide section 33B).

"E3" indicates an inner diameter of a rear end portion of the cover crimping range 30Ba, as an end portion into which the insulated wire 200 is inserted, of the crimping portion 30B in the X direction, and "D3" indicates an inner diameter of the guide section 33B. Herein in the third embodiment, to be more specific, the inner diameter D3 is, for example, 2.5 mm, and the inner diameter E3 is, for example, 3.1 mm. "A3" indicates a length between a rear end portion of the cover crimping range 30Ba in the X direction as an end portion into which the insulated wire 200 is inserted, and an end portion of an electric-wire-locking groove 34Ba, at the side of the cover crimping range 30Ba, that is the closest to the rear end portion among the electric-wire-locking grooves 34B. Herein, in the third embodiment, the length A3 is, for example, 4.2 mm. The inner diameter E3 of the rear end portion of the cover crimping range 30Ba in the X direction is larger than the outer diameter c of the insulated wire 200, i.e., b<c<E3. Hereby it is possible to improve operability and working efficiency when inserting the insulated wire 200 into the crimp terminal 10B.

Herein, in the crimping terminal 30B, similarly to the crimping portions 30 and 30A, the length A3 between the rear end portion of the cover crimping range 30Ba in the X direction and the end portion of the electric-wire-locking groove 34Ba at the side of the cover crimping range 30Ba is larger than the length a of the electric-wire-exposed part 201*a* (i.e., a<A3). As a result of that, when inserting the insulated wire 200 into the crimping portion 30B, the end 201*aa* of the electric-wire-exposed part 201*a* is inserted at first into the rear end portion of the cover crimping range 30Ba in the X direction, and the cover end 202*a* of the insulating cover 202 is inserted into the rear end portion of the cover crimping range 30Ba in the X direction before the end 201*aa* reaches the electric-wire-locking groove 34Ba. Herein at the time of the above-described insertion, it is preferable that a central axis of the insulated wire 200 coincides substantially with a central axis which is in parallel with the X direction of the crimping portion 30B. After that, the end 201*aa* reaches the electric-wire-locking groove 34Ba.

Hereby the insulated wire 200 is guided by the cover crimping range 30Ba of which inner diameter is E3, and thus, the orientation of the insulated wire 200 is regulated. As a result of that, the orientation of the insulated wire 200 becomes less inclined and thus more suitable for an inserting operation. As described above, the end 201*aa* subsequent to be in the orientation suitable for insertion reaches the electric-wire-locking groove 34Ba, an event is prevented that the end 201*aa* of the electric-wire-exposed part 201*a* is caught by the electric-wire-locking groove 34B to be deformed. Hereby, an operation of inserting the insulated wire 200 can be conducted stably, thus, an efficiency of a step of crimping of the insulated wire 200 is restrained from decreasing.

Since a tapered section is provided at a side of the cover crimping range 30Ba of the guide section 33B, the electric-wire-exposed part 201*a* is inserted into the electric wire crimping range 30Bb more smoothly. Herein from a view point of restraining the electric-wire-exposed part 201*a* from being caught by the tapered section for more smooth insertion, it is preferable that an angle θ defined by the tapered section of the guide section 33B relative to the X direction is equal to or smaller than 45°.

In the crimping portion 30B, similarly to the crimping portions 30 and 30A, the inner diameter D3 of the guide section 33B is larger than the outer diameter b of the electric-wire-exposed part 201*a*, and the outer diameter c of the insulated wire 200 is larger than the inner diameter D3 (i.e., b<D3<c). Since, hereby the cover end 202*a* of the insulating cover 202 enters not deeper than the guide section 33B, a quality of electric connection becomes stable between the aluminum core wire 201 and the crimp terminal 10B.

In the crimping portion 30B, similarly to the crimping portions 30 and 30A, a difference between the inner diameter D3 formed by the guide section 33B and the outer diameter b of the electric-wire-exposed part 201*a* is larger than a difference between the inner diameter E3 of the cover crimping range 30Ba and the outer diameter c of the insulated wire 200 (i.e., E3−c<D3−b). Hereby since, even if the orientation of the insulated wire 200 is regulated by the cover crimping range 30Ba, a clearance is obtained between the guide section 33B and the electric-wire-exposed part 201*a*, an event is prevented more reliably that the end 201*aa* of the electric-wire-exposed part 201*a* is caught by the electric-wire-locking groove 34B to be deformed.

Since a compressibility ratio (a value obtained by dividing a cross sectional area after crimping by a cross sectional area prior to crimping) at a time of crimping can be maintained to a large degree by increasing the thickness of the electric wire crimping range 30Bb, damage or deformation of a terminal due to an excessive force can be prevented. In addition, as described above, since it is possible to control a positional relationship between the crimping portion 30B and the insulated wire 200 in an operation of insertion, it is possible to achieve a stable sealability of the crimped crimp terminal 10B against moisture.

Figure 11A:
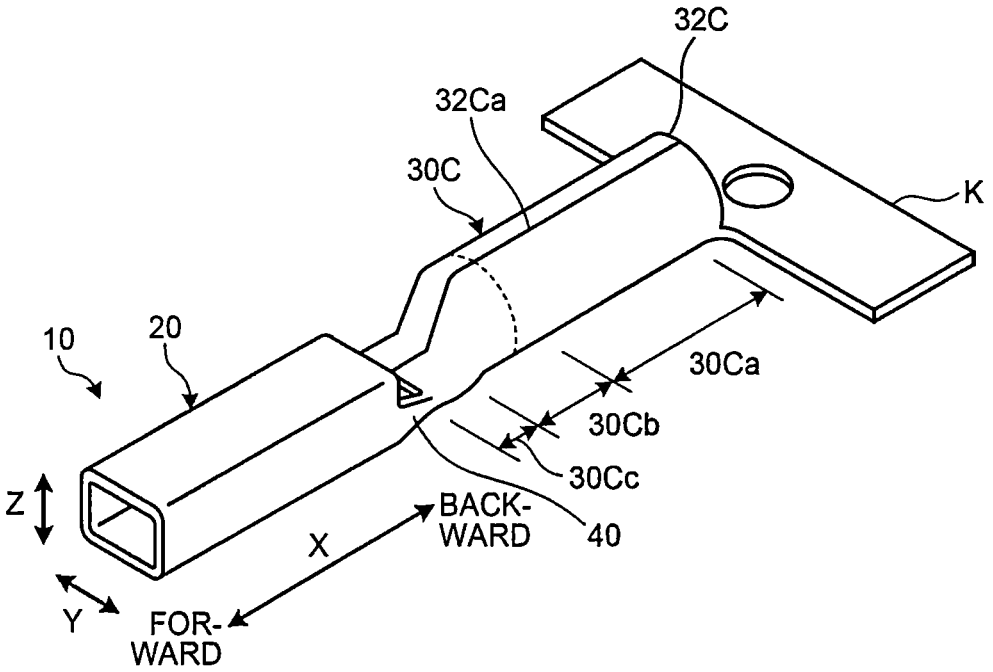
FIG. 11A illustrates a method for welding a crimping portion of a fourth embodiment of the present invention.
Figure 11B:
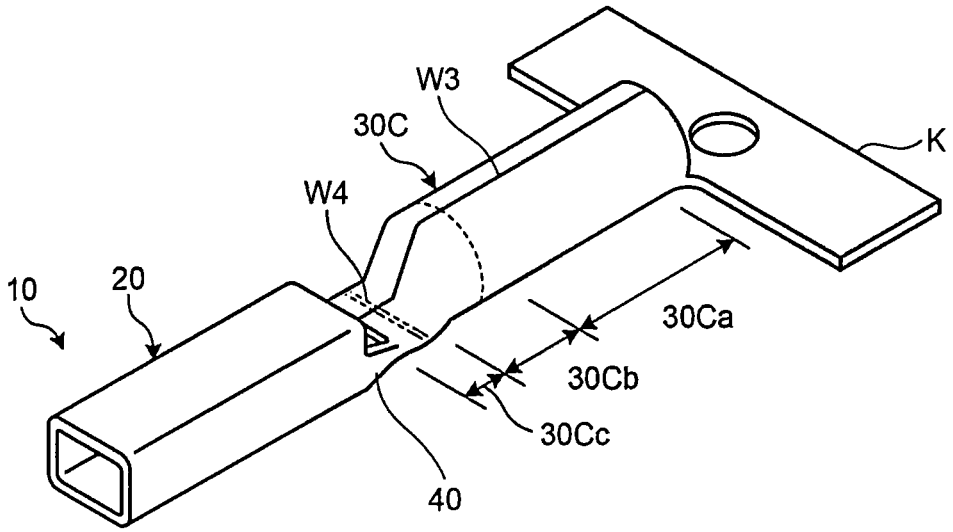
FIG. 11B illustrates a method for welding the crimping portion of the fourth embodiment of the present invention.
Figure 11C:
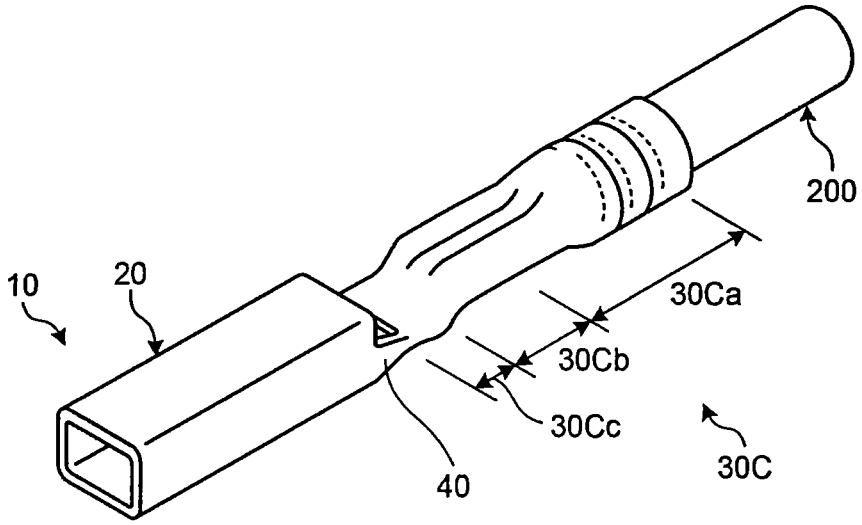
FIG. 11C illustrates a method for welding the crimping portion of the fourth embodiment of the present invention.

Hereafter a method for manufacturing a crimp terminal according to a fourth embodiment of the present invention will be explained. FIGS. 11A, 11B, and 11C are perspective views showing a method of welding a crimping portion by a method for manufacturing the crimp terminal according to the fourth embodiment.

As shown in FIGS. 11A to 11C, unlike the method for manufacturing the crimp terminal 10 according to the first embodiment, in the fourth embodiment, a welding is conducted so that a longitudinal direction welding point W3 varies in a height direction. In this case, the crimping portion 30 having a sealability against moisture can be configured in various shapes, e.g., the crimp terminal 10A or the like having the shift-neck portion 41 described in the modification example of the second embodiment can be manufactured.

That is, a copper alloy strip as a plate material is punched by press molding into a shape of a terminal as shown in FIG. 11A, then the punched copper alloy strip is rolled, and a front end portion thereof in the longitudinal direction X is crushed to form a shape of the crimping portion 30C including the sealing portion 30Cc in advance.

Fiber laser welding is conducted to both of facing end sections 32Ca, which are to be rolled and butted, along a longitudinal direction welding point W3 in the longitudinal direction X, and a sealing portion 30Cc is welded, and sealed, along a width-directional welding point W4 in the width direction Y. The crimping portion 30C is finished as described above. Herein, as shown in FIGS. 2A, 2B, and 2C, since the above-described sequence of steps of fiber laser welding are conducted to the crimp terminal 10 according to the first embodiment in a so-called cut-open-back state, the crimp terminal 10 must be reversed in a production process. In contrast, in the fourth embodiment, as shown in FIGS. 11A and 11B, the crimp terminal 10 can be manufactured in the above-described sequential process from press molding to the fiber laser welding without being reversed. Therefore, a manufacturing process can be simplified, and thus mass production, e.g., several hundreds of pieces per minute of crimp terminals can be achieved, a low-cost production can be intended.

As shown in FIGS. 2A to 2C, both the facing end sections 32Ca may be butted and sealed at a bottom surface side of the crimping portion 30C. Alternatively, as shown in FIGS. 11A and 11B, both the facing end sections 32Ca may be butted and sealed at an upper surface side of the crimping portion 30C. Further alternatively, as shown in FIG. 11C, a cover crimping range 30Ca of the crimping portion 30C is crimped against the insulating cover 202 of the insulated wire 200 in a circular shape in front view, and an electric wire crimping range 30Cb may be crimped against the aluminum core wire 201 in an approximate round-U shape in front view in the crimped state.

As shown in FIGS. 11A to 11C, the crimping portion 30C may be welded to the crimp terminal 10 while the crimp terminal 10 is attached to a belt-shaped carrier K, and then the crimp terminal 10 may be separated from the carrier K when, or after, the insulated wire 200 is crimp-connected. Alternatively, the crimp terminal 10 may be formed in a separated state from the carrier K, and then, the insulated wire 200 may be crimp-connected.

Because of the above-described production process, it is possible to produce a crimp terminal 10 capable of realizing a crimped state having little gap and high sealability against moisture in a state where the aluminum core wire 201 is inserted into, and crimped to, the crimping portion 30C. Therefore, it is possible to produce the crimp terminal 10 such as a female crimp terminal or the like capable of realizing a crimped state in which there is little gap and sealability against moisture is high even if a diameter of the aluminum core wire 201 is small.

Although the embodiments, to which the invention conceived by the present inventors were applied, have been explained, the descriptions and drawings as a part of the disclosure by the embodiments of the present invention do not limit the present invention. That is, other embodiment, example, and operational technology or the like carried out by an ordinary skilled person in the art based on the present embodiments are all included in the scope of the present invention.

For example, in the above-described embodiments, although an example was explained in which the crimping portion 30 of the crimp terminal 10 is crimp-connected to the aluminum core wire 201 made of aluminum or aluminum alloy, other metals may be used to a core wire, for example, a metal conductor made of copper (Cu) or Cu alloy or the like or a copper-clad aluminum wire (CA wire) or the like in which copper is disposed around an outer periphery of an aluminum wire can be used. In the above-described embodiments, lasers such as YAG laser or $CO_2$ laser other than fiber laser welding may be used for welding under a predetermined condition.

According to the present invention is capable of restraining deterioration of a conductor from being caused by permeation of moisture without lowering the efficiency of a step of crimping of the insulated wire by improving a sealability of moisture to a greater degree.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A crimp terminal comprising a crimping portion crimp-connecting a conductor portion exposed from an insulated wire including the conductor portion and a cover covering the conductor portion, wherein, the crimping portion is formed in a hollow cylindrical shape in cross section and has a first end portion and a second end portion opposite to the first end portion, the conductor portion is inserted into the first end portion in a longitudinal direction, and the second end portion is sealed, the second end portion at the opposite side is sealed by welding, the crimping portion, in which the exposed conductor portion is crimped, further includes a locking section locking the exposed conductor portion, and a length between the first end portion into which the conductor portion is inserted and a portion, of the locking section, that is the closest to the first end portion is larger than a length of the exposed conductor portion of the insulated wire.

2. The crimp terminal according to claim 1, wherein the crimping portion, into which the exposed conductor portion is inserted, has a guide section, and an inner diameter of the guide section is smaller than an outer diameter of the cover of the insulated wire and larger than an outer diameter of the conductor portion.

3. The crimp terminal according to claim 2, wherein, a difference between the inner diameter formed by the guide section of the crimping portion and the outer diameter of the exposed conductor portion is larger than a difference between an inner diameter of the first end portion of the crimping portion into which the exposed conductor portion is inserted and the outer diameter of the cover of the insulated wire.

4. The crimp terminal according to claim 1, wherein an outer diameter of the exposed conductor portion is smaller than the outer diameter of the cover of the insulated wire, and an inner diameter of the first end portion of the crimping portion into which the exposed conductor portion is inserted is larger than the outer diameter of the cover of the insulated wire.

5. The crimp terminal according to claim 1, wherein the sealed second end portion is sealed by fiber laser welding.

6. The crimp terminal according to claim 1, wherein the conductor portion is made of an aluminum-based material, and the crimping portion is made of a copper-based material.

7. A crimp-connection structural body, comprising:

a crimp terminal which comprises a crimping portion crimp-connecting a conductor portion exposed from an insulated wire including the conductor portion and a cover covering the conductor portion, wherein, the crimping portion is formed in a hollow cylindrical shape in cross section and has a first end portion and a second end portion opposite to the first end portion, the conductor portion is inserted into the first end portion in a longitudinal direction, and the second end portion is sealed, the second end portion at the opposite side is sealed by welding, the crimping portion, in which the exposed conductor portion is crimped, further includes a locking section locking the exposed conductor portion, and a length between the first end portion into which the conductor portion is inserted and a portion, of the locking section, that is the closest to the first end portion is larger than a length of the exposed conductor portion of the insulated wire; and the insulated wire in which the conductor portion is crimp-connected to the crimp terminal.

8. The crimp-connection structural body according to claim 7, configuring a wire harness comprising at least a combination of the crimp terminal and the insulated wire.

9. A method for manufacturing a crimp-connection structural body, comprising:

inserting an insulated wire into a crimp terminal which comprises a crimping portion crimp-connecting a conductor portion exposed from the insulated wire including the conductor portion and a cover covering the conductor portion, wherein, the crimping portion is formed in a hollow cylindrical shape in cross section and has a first end portion and a second end portion opposite to the first end portion, the conductor portion is inserted into the first end portion in a longitudinal direction, and the second end portion is sealed, the second end portion at the opposite side is sealed by welding, the crimping portion, in which the exposed conductor portion is crimped, further includes a locking section locking the exposed conductor portion, and a length between the first end portion into which the conductor portion is inserted and a portion, of the locking section, that is the closest to the first end portion is larger than a length of the exposed conductor portion of the insulated wire; and crimp-connecting the exposed conductor portion of the insulated wire to the crimp terminal.

* * * * *